US009267282B2

(12) United States Patent
Vieira Da Cunha

(10) Patent No.: US 9,267,282 B2
(45) Date of Patent: Feb. 23, 2016

(54) BLOCK FOR CONSTRUCTION AND METHOD TO BUILD WALLS WITH SAID BLOCK

(76) Inventor: António José Vieira Da Cunha, Gondomar (PT)

( * ) Notice: Subject to any disclaimer, the term of this patent is extended or adjusted under 35 U.S.C. 154(b) by 0 days.

(21) Appl. No.: 13/583,560

(22) PCT Filed: Mar. 9, 2011

(86) PCT No.: PCT/IB2011/050980

§ 371 (c)(1),
(2), (4) Date: Nov. 14, 2012

(87) PCT Pub. No.: WO2011/111002

PCT Pub. Date: Sep. 15, 2011

(65) Prior Publication Data

US 2013/0091798 A1 Apr. 18, 2013

(30) Foreign Application Priority Data

Mar. 9, 2010 (PT) ..... 105009

(51) Int. Cl.
*E02D 29/02* (2006.01)
*E04C 1/39* (2006.01)
(Continued)

(52) U.S. Cl.
CPC . *E04C 1/39* (2013.01); *E02D 29/02* (2013.01); *E02D 29/025* (2013.01); *E04B 2/02* (2013.01); *E04B 2/12* (2013.01); *E04C 1/395* (2013.01); *E04B 2002/0213* (2013.01)

(58) Field of Classification Search
CPC ... E02D 29/02; E02D 29/025; E02D 29/0266; E04B 2/02; E04C 1/395; E04C 1/00
USPC ..... 52/561, 569, 574, 596, 604, 605.612, 52/745.09, 745.1
See application file for complete search history.

(56) References Cited

U.S. PATENT DOCUMENTS 5,472,297 A * 12/1995 Heselden ..... E04C 1/395 405/258.1
5,636,938 A * 6/1997 Ragazzo ..... E02B 3/127 405/15

(Continued)

FOREIGN PATENT DOCUMENTS

CA 2108964 * 4/1995 ..... E02D 29/02
DE 30 29 494 B1 4/1981

(Continued)

OTHER PUBLICATIONS

International Search Report, mailed Aug. 24, 2011 in connection with PCT International Application No. PCT/IB2011/050980, filed Mar. 9, 2011.

(Continued)

*Primary Examiner* — Brian Glessner
*Assistant Examiner* — Adam Barlow
(74) *Attorney, Agent, or Firm* — John P. White; Cooper & Dunham LLP

(57) ABSTRACT

A block for construction of foundation systems retaining walls and gabions and to methods to build walls or gabions from said block. The block is comprised by at least two sides or faces of rectangular and flat configuration (1 and 2); at least one side or face (3) which has at least one of the ends in convex form; at least two sides or faces (4 and 5) which have at least one of its ends in convex form and that together with the convex end of the side or face (3) can provide said block with an apex (6) and respective geodynamic form. The present block is intended for the civil construction sector, more specifically for the construction of retaining walls by means of blocks or applying formwork with the form of the blocks.

13 Claims, 12 Drawing Sheets

(51) Int. Cl.
*E04B 2/12* (2006.01)
*E04B 2/02* (2006.01)

(56) References Cited

U.S. PATENT DOCUMENTS

| | | | | | |
|---|---|---|---|---|---|
| 5,788,424 | A * | 8/1998 | Torch | E02D 29/025 | 405/262 |
| 5,791,827 | A * | 8/1998 | Arvai | E02D 29/025 | 405/284 |
| 2009/0202308 | A1 * | 8/2009 | Heselden | E02D 29/0208 | 405/273 |
| 2010/0024343 | A1 * | 2/2010 | Eggermont | E02D 29/0208 | 52/648.1 |
| 2012/0134756 | A1 * | 5/2012 | Heselden | E02D 29/0208 | 405/273 |
| 2012/0137598 | A1 * | 6/2012 | Chamoux | E02D 31/004 | 52/173.1 |

FOREIGN PATENT DOCUMENTS

| | | | | | |
|---|---|---|---|---|---|
| DE | 197 46 295 | A1 | | 4/1999 | |
| EP | 0 191 908 | A1 | | 8/1986 | |
| FR | 2 188 634 | | | 1/1974 | |
| JP | 2003261918 | | * | 9/2003 | E02B 3/08 |
| KR | 10-2009-0129617 | | | 12/2009 | |
| KR | 20090129617 | | * | 12/2009 | E02B 3/04 |
| KR | 20090129617 | A | * | 12/2009 | E02B 3/04 |

OTHER PUBLICATIONS

Written Opinion of the International Searching Authority, mailed Aug. 24, 1011 in connection with PCT International Application No. PCT/IB2011/050980, filed Mar. 9, 2011.

* cited by examiner

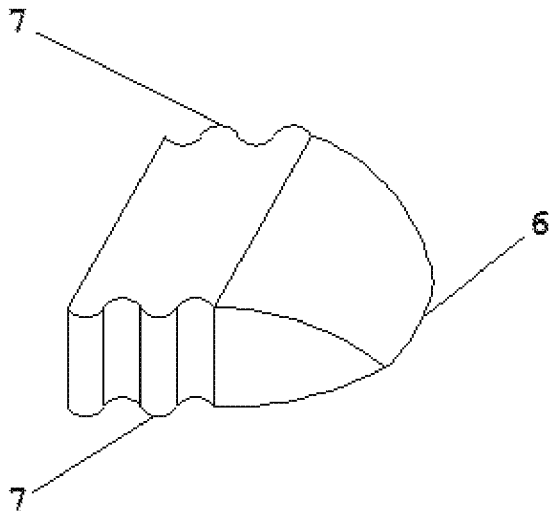
Figure 3
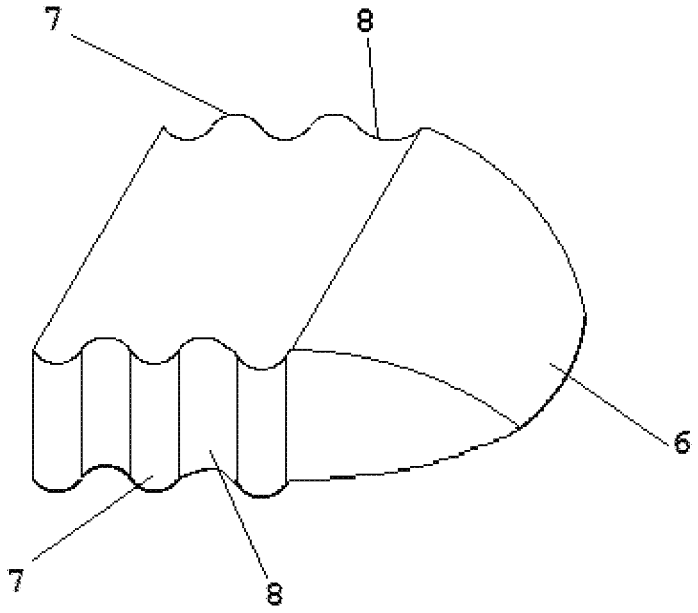
Figure 3-A

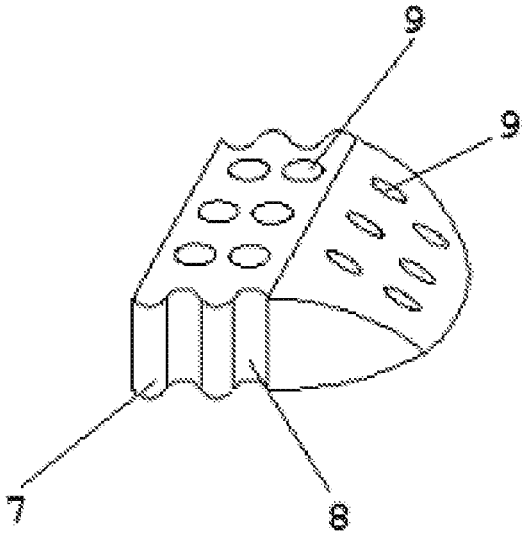
Figure 4
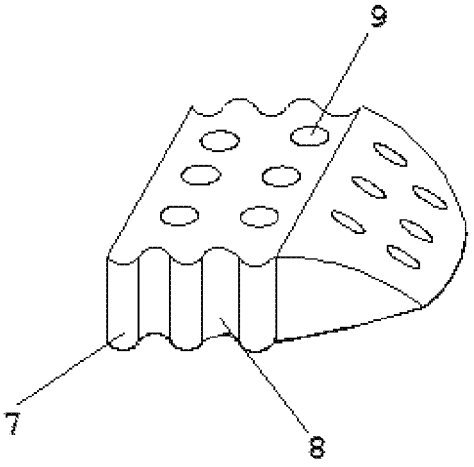
Figure 4-A

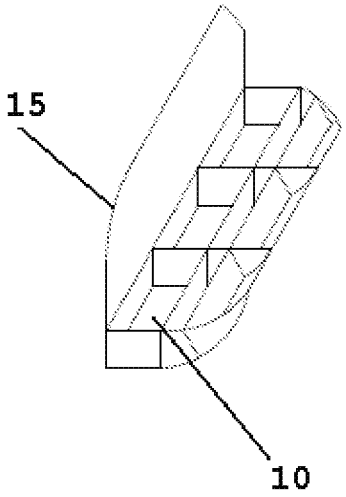
Figure 5
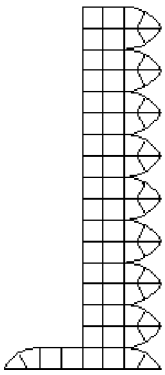
Figure 5-A

BLOCK FOR CONSTRUCTION AND METHOD TO BUILD WALLS WITH SAID BLOCK

CROSS-REFERENCE TO RELATED APPLICATIONS

This application is a §371 national stage of PCT International Application No. PCT/IB2011/050980, filed Mar. 9, 2011, claiming priority of Portuguese Patent Application No. 105009, filed Mar. 9, 2010, the contents of each of which are hereby incorporated by reference in their entirety.

FIELD OF THE INVENTION

The present invention is intended for the civil construction sector, more specifically for the construction of retaining walls, walls and the like.

PRIOR ART

Over the years, the civil construction sector has presented numerous technological solutions to optimize all processes and products targeted for construction.

As a way to optimize existing walls, reduce waste of manpower, save materials and time, bricks or blocks with different geometries have been developed.

The walls to support land that work by gravity are characterized by having high self-weight and low stability. This kind of walls is characterized by being constructed along the embankment of earth and acts vertically through the self-weight imposed on the base. However, they receive a boost from the land which acts horizontally and may lead to its collapse.

Of various kinds of blocks found intended for gravity walls the following are highlighted for being considered as the closest to the present invention:

The Patent document CA2661583 presents as main features the fitting and locking by means of rods introduced in the orifices of the blocks. This block has a common shape of parallelepiped with a rectangular area in the inner face, parallel to the slope and thereby disadvantageous in that it directly receives the efforts of the land on its surface. Unlike the walls designed from the present invention, it requires foundations and applies its own weight in these foundations. On the other hand it does not take advantage of the efforts of the impulse and does not dissipate the impulse in several directions, neither does it increase the absorption area of said impulse.

Document US 2007166112 (A1) presents a wall made of blocks with a fitting on the upper and bottom faces, with a sloping face, limiting its application to basements of buildings. This block has a geometric configuration of a parallelepiped resulting in a rectangle in the inner face parallel to the slope, a disadvantage compared to the present invention once the area that projects the efforts of the slope is equal to that of the wall and other disadvantage that it does not take advantage of its own weight to discharge on the terrain of the slope. Also the fact that the efforts of the terrain acting perpendicularly to the inner face of the wall represents a disadvantage relative to the block presented here. To use this wall, foundations are also required to keep it fixed.

Document EP1747331 (A1) refers to a concrete block for a retaining wall with sloping wall, formed by trapezes in the horizontal direction. In spite of said block presenting an area in the outer face of the trapeze larger than the inner area, which permits a reduction on the impulse effect on the wall, the inner face of the block has an area parallel to the slope, a very unfavourable situation given that it is not geodynamic, that is, it does not dissipate the forces of the impulse in multiple directions, unlike what happens in the present invention that allows these forces to decompose into two forces that cause movements in the opposite direction. The fact that it has a horizontally trapezoid configuration and the way they are based does not favour the insulation from humidity since this geometry allows the penetration of land in the block. This type of block for the construction of basement of buildings is not advantageous in view of forming a slanted wall. It also does not allow that the wall becomes active, requiring foundations.

It is intended with the present invention to present a new block and method of construction which permits the construction of gravity walls in a quick and simple manner, without use of metal armour and more difficult to demolish.

GENERAL DESCRIPTION

The present invention relates to a block for construction of foundation systems and to methods to build walls from said block. The block is comprised by at least two sides or faces of rectangular and flat configuration (1 and 2); at least one side or face (3) which has at least one of the ends in convex form; at least two sides or faces (4 e 5) which have at least one of its ends in convex form and that together with the convex end of the side or face (3) can provide said block with an apex (6) and respective geodynamic form.

Said block can furthermore have two of the ends of the sides or faces (4A e 5A) in convex form and directed inwards, thus presenting 5 convex lines which result in a ogival shape and causing the polyhedron to exhibit a smaller width at the apex (6) compared to the rest of the body (FIG. 2).

In order to save material, reduce weight for transport and placement during the construction of the wall and still make the prefabricated block cheaper, the block may contain cavities or circular alveoli (9) as shown in FIGS. 4 and 4-A, for filling with materials such as sand or other aggregates. The aggregates are placed in the alveoli in order to increase the weight of the block itself, since it unloads into the slope. In order to optimize the fitting during construction of the wall and so that it remains concise, the block may contain on the side faces (4 and 5) at least two semicircular notches (7) or (8) of the tongue and groove type, respectively, to allow the fitting between blocks.

In the case of the wall being built is a gabion type wall, as shown in FIG. 5-A, the block should be composed of metallic mesh and its interior compartmentalized (10) to allow the incorporation of stones or other filler material (FIG. 5).

The block shown here, in its various preferred embodiments, allows gains in stability since the impulse projected by the slope is dissipated in different directions, reducing its effect on the surface of the block, also increasing the absorber area and acting with its own weight on the slope, making it active, as it is intended to show in FIGS. 8 and 9.

The block object of the present invention avoids the use of metal armours (as happens with other retaining walls in reinforced and prestressed concrete) in the construction of walls, since this format is incorporated on the slope, compressing it. It should be constructed, preferably, of concrete or solid recycled concrete, cast on site by formwork, prefabricated concrete blocks or ceramic bricks to be assembled on site or with boxes of metallic mesh, gabion type, allowing the construction of stable walls and without short term maintenance.

Such as shown in FIG. 6, the fitting performed symmetrically allow the blocks to be coupled to create the rabbet, which represents the evolution of the polyhedron shown in sectional view in FIG. 7 which allows filling, by means of its geodynamic form, the bad behaviour of the usual stones used in the manufacture of walls to the efforts of traction.

With the implementation of these blocks in the retaining walls, the self weight acts on the slope, in arch, from outside to inside and from top to bottom, lessening the effect of impulse as shown in FIGS. 8 and 9. For the construction of walls or foundations walls is required the overlapping of the various rabbets which is performed by combining the faces or sides (2) of the polyhedron, allowing proper packaging and weight distribution of the soil when filling or covering the walls. The projected impulse acts in the perpendicular direction taking advantage of the compression of rock, an effect similar to the Roman arch. This format allows for increased stability either for demolition or slippage once the wall becomes active, projecting the self-weight of the blocks to the ground and creating an increase in the area that absorbs the effect of the impulse. As this is a tension, by increasing the application area two-fold, the tension effect is proportionally reduced, in this case, to half. In the segmented blocks (FIG. 3, 3-A, 4, 4-A or FIGS. 12 and 13) notched, the block area increases and the impulse is also projected on the lateral arch. This effect dissipates the impulse turning it on the surfaces of the opening.

On the other hand, said block can also be characterized by having a more irregular shape on two of its faces, which are composed of bends (11) and semi-elliptical notches (12) that allow for the formation of small filling holes (13) and (14) to reinforce the wall, as exemplified in FIG. 14. If desired, said blocks may also be comprised of filling alveoli as shown in FIGS. 12 and 13.

BRIEF DESCRIPTION OF THE DRAWINGS

FIG. 3-A—Schematic view of the block, where the numbers represent the following:
6—Apex
7—Semi-circular notch "tongue"
8—Semi-circular notch "groove"

FIG. 4—Schematic view of the block, where the numbers represent the following:
7—Semi-circular notch "tongue"
9—Alveoli FIG. 4-A—Schematic view of the block, where the numbers represent the following:
7—Semi-circular notch "tongue"
8—Semi-circular notch "groove"
9—Alveoli FIG. 5—Schematic view of the block, where the numbers represent the following:
10—Compartmentalized interior
15—Tampa FIG. 5-A—Schematic view of the gabion type wall FIG. 6—Schematic view of the union or rabbet in which the numbers represent the following:
6—Apex FIG. 7—Schematic view of masonry with emphasis on the trapeze.

DETAILED DESCRIPTION OF THE INVENTION

For an easier understanding of the invention, some examples of preferred embodiments of the block and the method of building the wall are described in the following, which, however, are not intended to limit the object of the invention. The great feature of this block in its various embodiments consists basically on its geometry as well as in how it is placed upon construction of the wall.

Figure 1:
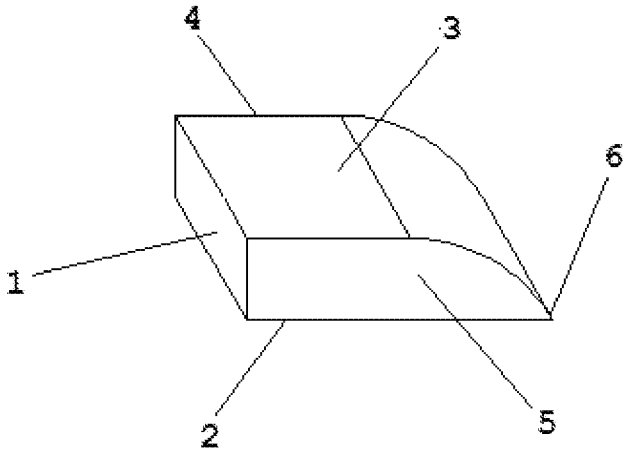
FIG. 1—Schematic view of the block, where the numbers represent the following:
1 and 2—Sides or faces of rectangular shape and flat
3—Side or face of a convex end
4 and 5—Sides or faces of a convex end
6—Apex FIG. 2—Schematic view of the block, where the numbers represent the following:
4A and 5A—Sides or faces of convex end facing the inside
6—Apex FIG. 3—Schematic view of the block, where the numbers represent the following:
6—Apex
7—Semi-circular notch "tongue"

FIG. 1 refers to a block, which is comprised of two sides or faces of a rectangular and flat configuration (1 e 2); one side or face (3) which comprises one of the ends in convex form; two sides or faces (4 and 5) which comprise one of the ends in convex form and which, together with the convex end of the side or face (3) can provide said block with an apex (6) and respective geodynamic form. The length of the referential polyhedron ranges from 30 to 40 cm and the height should be 20 cm. The width of the larger base measures 65 cm and the smaller base is 30 cm.

Figure 2:
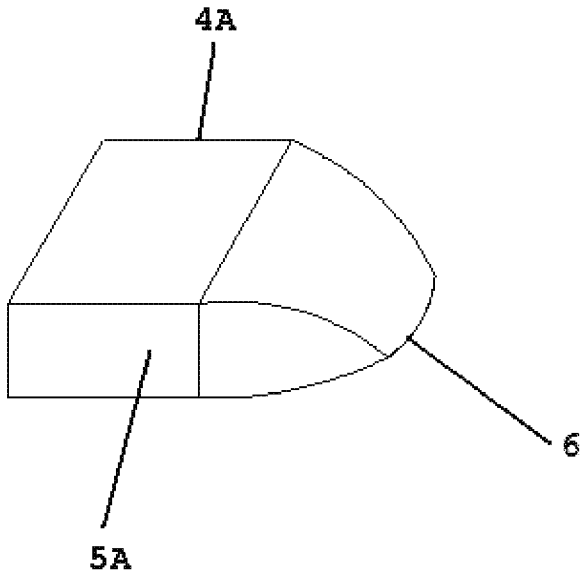
Figure 6:
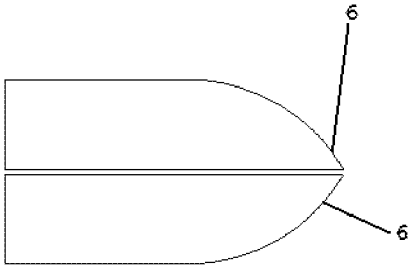
Figure 7:
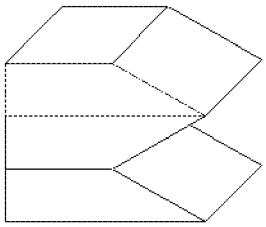
Figure 8:
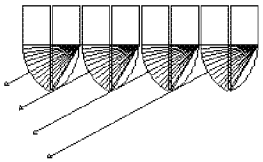
FIG. 8—Schematic view of the performance of the blocks on the slope.
Figure 9:
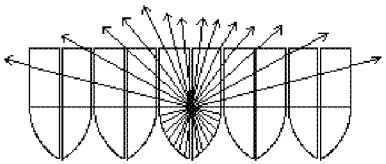
FIG. 9—Schematic view of the effect of impulse on the wall.

In another preferential embodiment, said block may have two of the ends of sides or faces (4A e 5A) in a convex form and directed inwards, thus comprising 5 convex lines, resulting in an ogival shape and causing the polyhedron to have a smaller width at the apex (6) compared to the rest of the body (FIG. 2).

In another preferential embodiment and in order to allow a better fitting upon the construction of the wall, the block object of this invention may further be constructed of various semi-circular notches of the tongue and groove type (7) and (8) in two of its side faces, such as shown in FIGS. 3 and 3-A.

In another preferential embodiment the block may contain cavities or circular alveoli (9) such as illustrated in FIGS. 4 and 4-A for filling with some materials such as sand and other aggregates and could be further formed by several semi-circular notches of the tongue and groove type (7) and (8) in two of its side faces. The aggregates are placed in the alveoli in order to increase the weight of the block, since it unloads into the slope.

A FIG. 5 refers to another embodiment of the block, comprised of boxes in metallic mesh, of the gabion type. The interior of the block is compartmentalized either in the longitudinal or transversal direction so as to allow a better packaging of the stones. For placement of the stones, the block has an opening in the shape of a lid (15) whose location varies according to the place of the block. In placing these blocks, the lids must be facing upwards. The height of the boxes varies from 40 cm to 90 cm.

The sizing of the various blocks is done by evaluating the position of the centre of gravity in order to ensure stability. For this reason the walls can only be built with blocks of other sizes if they are proportional.

Figure 12:
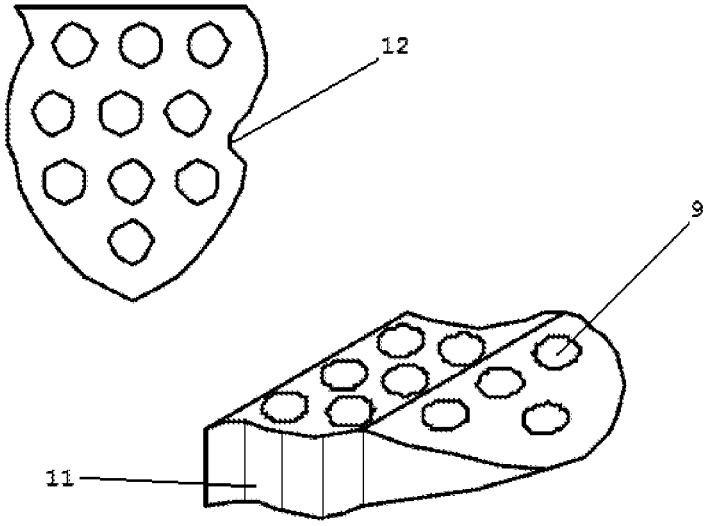
FIG. 12—Schematic view of the block, where the numbers represent the following:
9—Alveoli
11—Bends for fitting
12—Semi-elliptical notch for fitting FIG. 13—Top view of the block in which the numbers represent the following:
11—Bends for fitting
12—Semi-elliptical notch for fitting FIG. 14—Schematic view of the wall, where the numbers represent the following:
13 e 14—Filling holes
Figure 13:
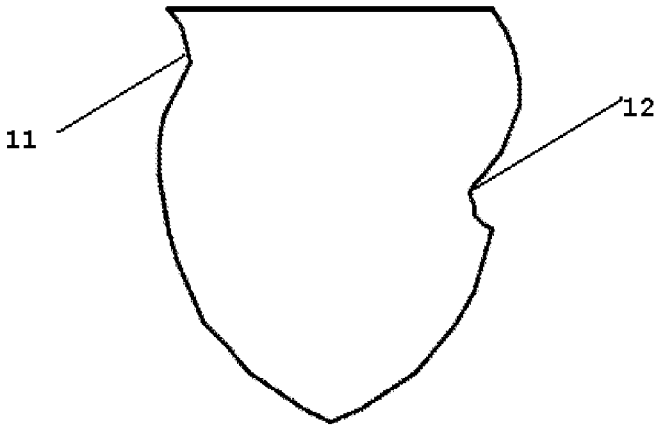
Figure 14:
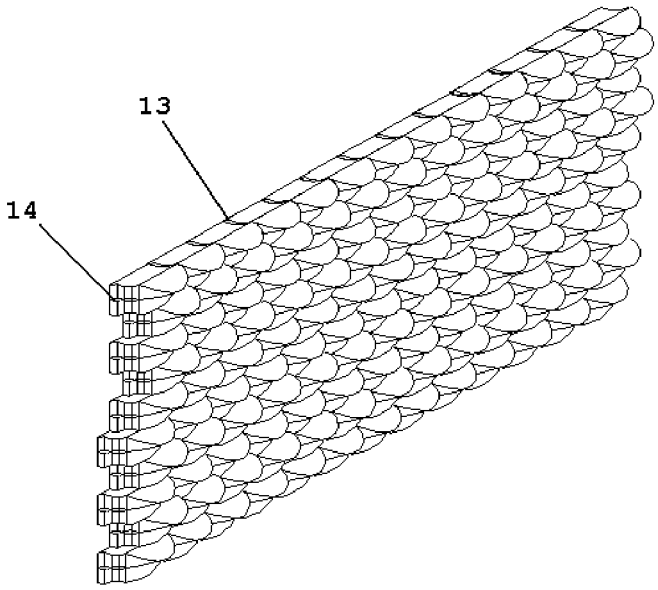

Another embodiment of said block is characterized in that it comprises a more regular shape in two of its faces, which are comprised of curves for fitting (11) and semi-elliptic notches (12) that allow to create small filling holes (13) and (14) in order to reinforce the wall. If desired, said blocks may also comprise filling alveoli such as shown in FIGS. 12 and 13. The length of this block should be 3 times proportional to its height.

Construction of the Wall

The construction of the wall is effected in the same manner for each of the embodiments previously mentioned.

Figure 10:
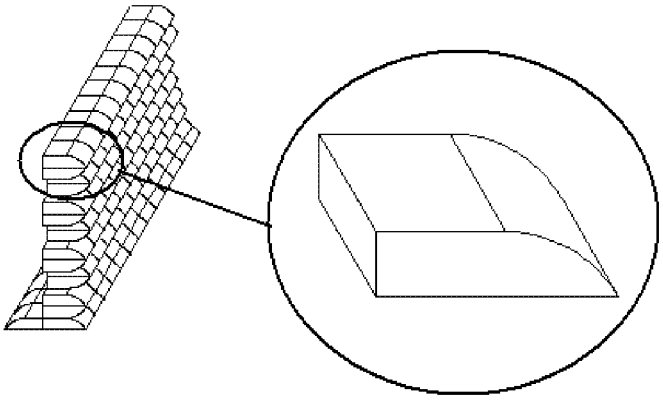
FIG. 10—Schematic view of the wall and detail of the type of block used.
Figure 11:
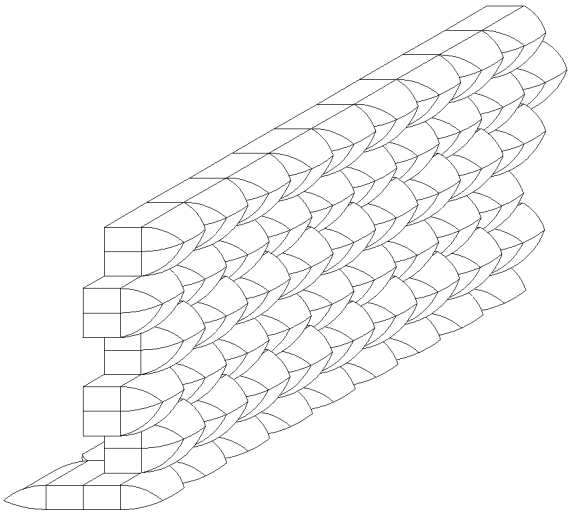
FIG. 11—Schematic view of the wall with blocks with 4 convex lines.

Soil compaction during laying of the blocks is essential to ensure a stronger bond and prevent accentuated deformation. As shown in FIG. 10 or 11 the first block to be laid, which will make the foundation, is set on the ground with the apex facing the opposite side of the slope. A first row is constructed and then the rabbets are laid joined by mortar and facing the slope, so that the apexes are embedded into the ground, allowing for the proper packaging and weight distribution of the land.

In the case that the rabbets are comprised of notches, these will allow a better fitting of each rabbet with the side rabbet.

During the inspection of these structures through finite element calculation, it has been found that the deformation caused by excessive efforts develops to the right, that is, on the land. This increases the safety in case of falling over.

For the construction of gabion type walls with blocks in boxes of metallic mesh, the placement thereof should be made so as to create a vertical face or with a maximum gradient of 2%.

The construction of walls with blocks of this material in the form of boxes is carried out with only one column of boxes without the need to use mortar and it is advisable to apply a geotextile adjacent to its back area in order to filter water, hold the land and thus increase the drainage.

For the construction of walls, the gabion modules should be constructed, preferably in metallic mesh for filling with aggregates, having 40 cm height, 60 cm height, 70 cm height, 80 cm height and 90 cm height for walls of 5 m, 10 m, 20 m and 25 m, respectively.

The use of modules with reference to each height requires the calculation performed by technicians as happens in other types of walls and in this calculation there may be the need to implement a module larger that the one described above. Said modules are only to serve as pre-sizing.

The blocks shown here can be built in ceramic bricks, concrete blocks, moulded concrete, moulded recycled concrete and natural stone (granite), with heights of less than four meters, and the wall can be built on site, with formwork.

The invention claimed is:

1. A building block that can be used in a foundation system, a retaining wall or a gabion, which comprises:

(a) at least one face of rectangular and flat configuration (1);

(b) at least one top face (3), which has at least one end in convex form;

(c) a bottom face (2) which has at least one end in convex form; and (d) at least two side faces (4A and 5A) each having at least one of its ends in convex form and being directed inwards, wherein the at least two side faces (4A and 5A) together with the convex end of the top face (3) and the convex end of the bottom face (2) provide said block with an apex or ridge (6) and provide an end of the building block with an ogival form.

2. The building block according to claim 1 which comprises cavities or alveoli (9).

3. The building block according to claim 2 which comprises sand and other aggregates in the cavities or circular alveoli (9).

4. The building block according to claim 1, wherein the two side faces (4 and 5) comprise at least two semi-circular notches (7) or (8) with fitting of the "tongue" and "groove" type.

5. The building block according to claim 1, wherein the block comprises concrete, pre-fabricated concrete or ceramic brick, or solid recycled concrete.

6. The building block according to claim 1, wherein the block comprises boxes of metallic mesh in its interior which serve as the gabion.

7. The building block according to claim 1, wherein the block comprises an irregular shape on at least two of its faces, which are composed of bends for fitting (11) and semi-elliptical notches (12) that allow for the formation filling holes (13) and (14).

8. A method of wall construction using the building blocks according to claim 1, the method comprising the following steps:

a) place in the first row a couple of blocks set on the ground with the apexes (6) one facing the slope and the other facing the exterior;

b) superimpose the blocks joining the faces (2) with mortar forming a rabbet with the first blocks placed underneath, in order to form a new row; and c) superimpose and join the non-convex faces or sides (3) of the nest rabbets, where the rabbet consists in fitting two blocks in a symmetrical form with the convex lines (3) facing the exterior of the union.

9. The method of construction of a wall according to claim 8, wherein the construction of the wall or gabion involves use of building blocks comprising boxes of metallic mesh and is carried out with only one column of boxes.

10. The method of construction of a wall according to claim 8, which comprises the application of a geotextile adjacent to the back area of the wall.

11. The method of construction of a wall according to claim 8, wherein the wall is constructed on site, with formwork.

12. The building block according to claim 1 further comprising an extrusion shaped as a lid for at least one of the two sides or faces of rectangular and flat configuration (1 and 2).

13. A building block that can be used in a foundation system, a retaining wall or a gabion, which comprises:

(a) at least one face of rectangular and flat configuration (1);

(b) at least one top face (3), which has at least one end in convex form;

(c) a bottom face (2) which has at least one end in convex form; and (d) at least two side faces (4A and 5A) each having at least one of its ends in convex form and being directed inwards, wherein the at least two side faces (4A and 5A) together with the convex end of the top face (3) and the convex end of the bottom face (2) provide said block with an apex or ridge (6) and provide an end of the building block with an ogival form, wherein an interior of the building block is divided into plural compartments in a longitudinal direction and in a transversal direction.

* * * * *